US007098807B2

(12) United States Patent
Séguin et al.

(10) Patent No.: US 7,098,807 B2
(45) Date of Patent: Aug. 29, 2006

(54) TRAFFIC-SIGNALING SYSTEM

(75) Inventors: Marc-André Séguin, Montreal (CA); Richard Séguin, St-Laurent (CA); Sylvain Gauthier, St-Constant (CA)

(73) Assignee: 9076-0935 Quebec Inc., Laval (CA)

( * ) Notice: Subject to any disclaimer, the term of this patent is extended or adjusted under 35 U.S.C. 154(b) by 90 days.

(21) Appl. No.: 10/715,490

(22) Filed: Nov. 19, 2003

(65) Prior Publication Data

US 2005/0102872 A1 May 19, 2005

(51) Int. Cl.
*G08G 1/095* (2006.01)
*E01F 9/00* (2006.01)

(52) U.S. Cl. ..... 340/907; 340/931; 404/9

(58) Field of Classification Search ..... 340/907, 340/931, 928; 434/305; 116/63 R; 404/6, 404/9, 10; 40/612, 614
See application file for complete search history.

(56) References Cited

U.S. PATENT DOCUMENTS

| | | | | | |
|---|---|---|---|---|---|
| 1,628,651 | A | * | 5/1927 | Burress | 49/9 |
| 2,409,076 | A | * | 10/1946 | Steinberger et al. | 116/173 |
| 3,876,973 | A | * | 4/1975 | Griebel | 340/928 |
| 3,886,519 | A | * | 5/1975 | Hovland | 340/908.1 |
| 4,016,679 | A | * | 4/1977 | Ellefson | 49/49 |
| 4,258,502 | A | * | 3/1981 | St. Cyr | 49/49 |
| 4,318,079 | A | * | 3/1982 | Dickinson | 340/928 |
| 4,333,268 | A | * | 6/1982 | Dumbeck | 49/34 |
| 4,955,753 | A | * | 9/1990 | McKay | 404/6 |
| 5,097,790 | A | * | 3/1992 | Massey | 116/63 P |
| 5,370,201 | A | * | 12/1994 | Inubushi | 340/426.2 |
| 5,373,664 | A | * | 12/1994 | Butler | 49/358 |
| 5,466,088 | A | * | 11/1995 | Nasatka | 404/6 |
| 5,551,796 | A | | 9/1996 | Anderson, Jr. et al. | |
| 5,673,039 | A | * | 9/1997 | Pietzsch et al. | 340/905 |
| 5,884,432 | A | * | 3/1999 | DeLillo | 49/49 |
| 6,101,750 | A | | 8/2000 | Blesener et al. | |
| 6,119,399 | A | * | 9/2000 | McCain et al. | 49/340 |
| 6,150,958 | A | * | 11/2000 | Worsham | 340/932.2 |
| 6,179,517 | B1 | * | 1/2001 | Nelson | 404/6 |
| 6,696,977 | B1 | * | 2/2004 | Thompson et al. | 340/905 |
| 2002/0175831 | A1 | * | 11/2002 | Bergan et al. | 340/908.1 |

FOREIGN PATENT DOCUMENTS

| | | |
|---|---|---|
| EP | 0 537 095 A2 | 4/1993 |
| FR | 2 650 846 A1 | 2/1991 |

* cited by examiner

*Primary Examiner*—Daniel Wu
*Assistant Examiner*—Eric M. Blount

(57) ABSTRACT

The present invention provides a traffic-signalling device suitable for providing information to oncoming traffic. The traffic-signalling device comprises a moveable member suitable for attachment to a support and a solar powered drive system. The moveable member is operative to move between a first position and a second position, wherein in the second position the traffic-signalling device is operative to provide information to oncoming traffic. The solar-powered drive system is suitable for causing the moveable member to move between the first position and the second position.

27 Claims, 10 Drawing Sheets

TRAFFIC-SIGNALING SYSTEM

FIELD OF THE INVENTION

The present invention relates to the field of traffic signalling systems and devices for providing information to oncoming traffic. More specifically, the present invention relates to traffic signalling systems and devices that are controlled at least in part by solar energy.

BACKGROUND OF THE INVENTION

Traffic signalling systems and traffic signalling devices for providing information to oncoming traffic are known in the art. Such traffic signalling systems and devices often provide information to oncoming traffic in the form of driving instructions and/or information regarding the condition of the upcoming road.

Generally, traffic signalling systems and devices are controlled by electrical cables that run along-side the road or highway. However, a deficiency with using electrical cables is that it is not always safe, or practical, to have electric power lines running along the side of a road or highway.

As such, there is a need in the industry for improved traffic signalling systems and devices that alleviate at least in part the deficiencies associated with the prior art systems and devices.

SUMMARY OF THE INVENTION

In accordance with a first broad aspect, the present invention provides a traffic-signalling device suitable for providing information to oncoming traffic. The traffic-signalling device comprises a moveable member suitable for attachment to a support, and a solar powered drive system. The moveable member is operative to move between a first position and a second position, wherein in the second position the traffic-signalling device is operative to provide information to oncoming traffic. The solar-powered drive system is suitable for causing the moveable member to move between the first position and the second position.

In accordance with a second broad aspect, the present invention provides a traffic-signalling system suitable for providing information to oncoming traffic. The traffic-signalling system comprises a plurality of traffic-signalling devices. Each traffic-signalling device comprises a moveable member suitable for attachment to a support and a solar powered drive system. The moveable member is operative to move between a first position and a second position, wherein in the second position the traffic-signalling device is operative to provide information to oncoming traffic. The solar-powered drive system is suitable for causing the moveable member to move between the first position and the second position.

In accordance with another broad aspect, the present invention provides a traffic-signalling device suitable for providing information to oncoming traffic. The traffic-signalling device comprises a moveable member suitable for attachment to a support, a drive system and a solar powered control system. The moveable member is operative to move between a first position and a second position, wherein in the second position the traffic-signalling device is operative to provide information to oncoming traffic. The drive system is suitable for causing the moveable member to move between the first position and the second position and the solar powered control system is suitable for allowing the drive system to move the movable member between the first position and the second position.

Other aspects and features of the present invention will become apparent to those ordinarily skilled in the art upon review of the following description of specific embodiments of the invention in conjunction with the accompanying figures.

DETAILED DESCRIPTION

Figure 1:
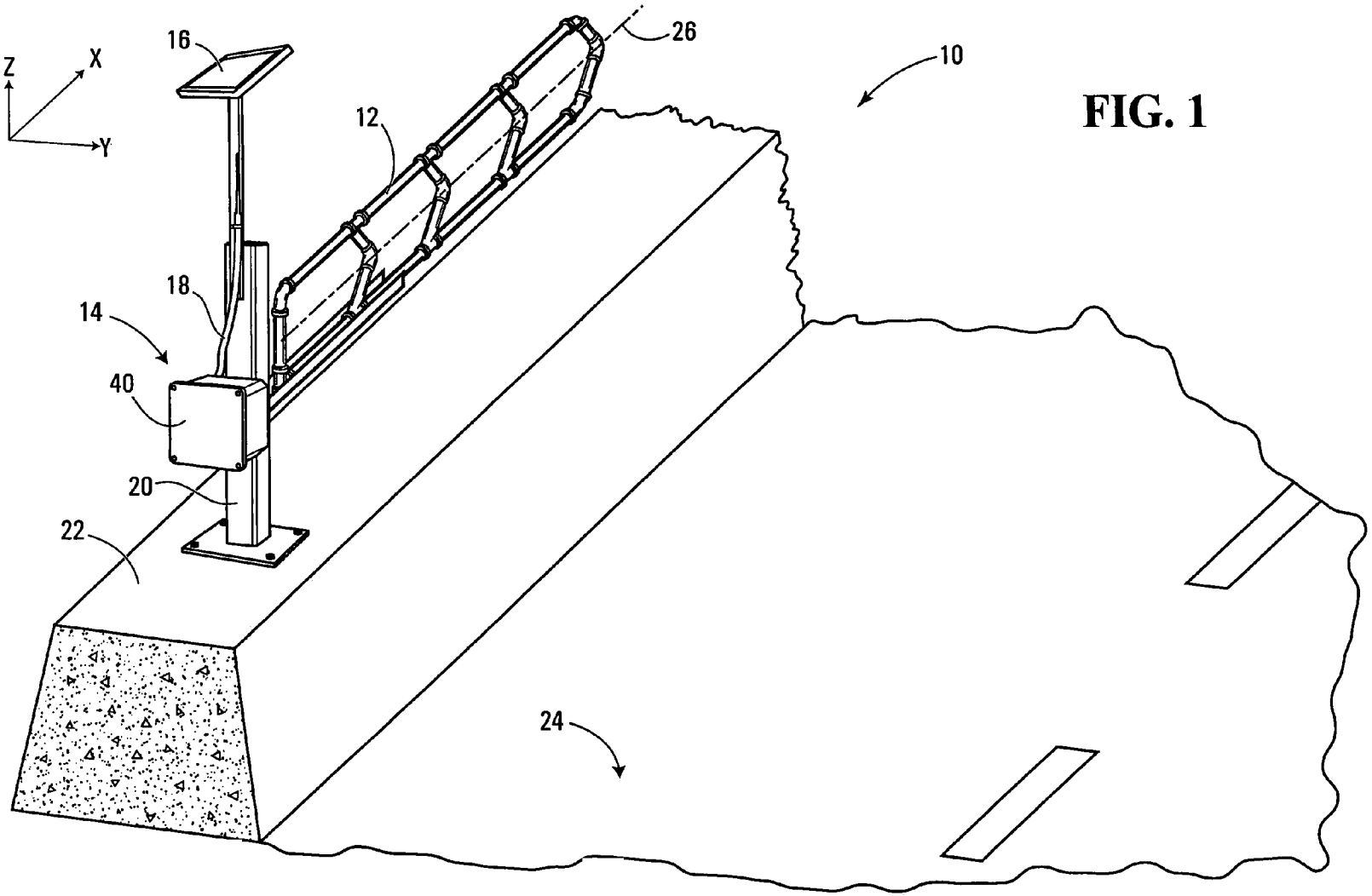
FIG. 1 shows a traffic-signalling device in accordance with a non-limiting example of implementation of the present invention, with a movable member in a first position.
Figure 2:
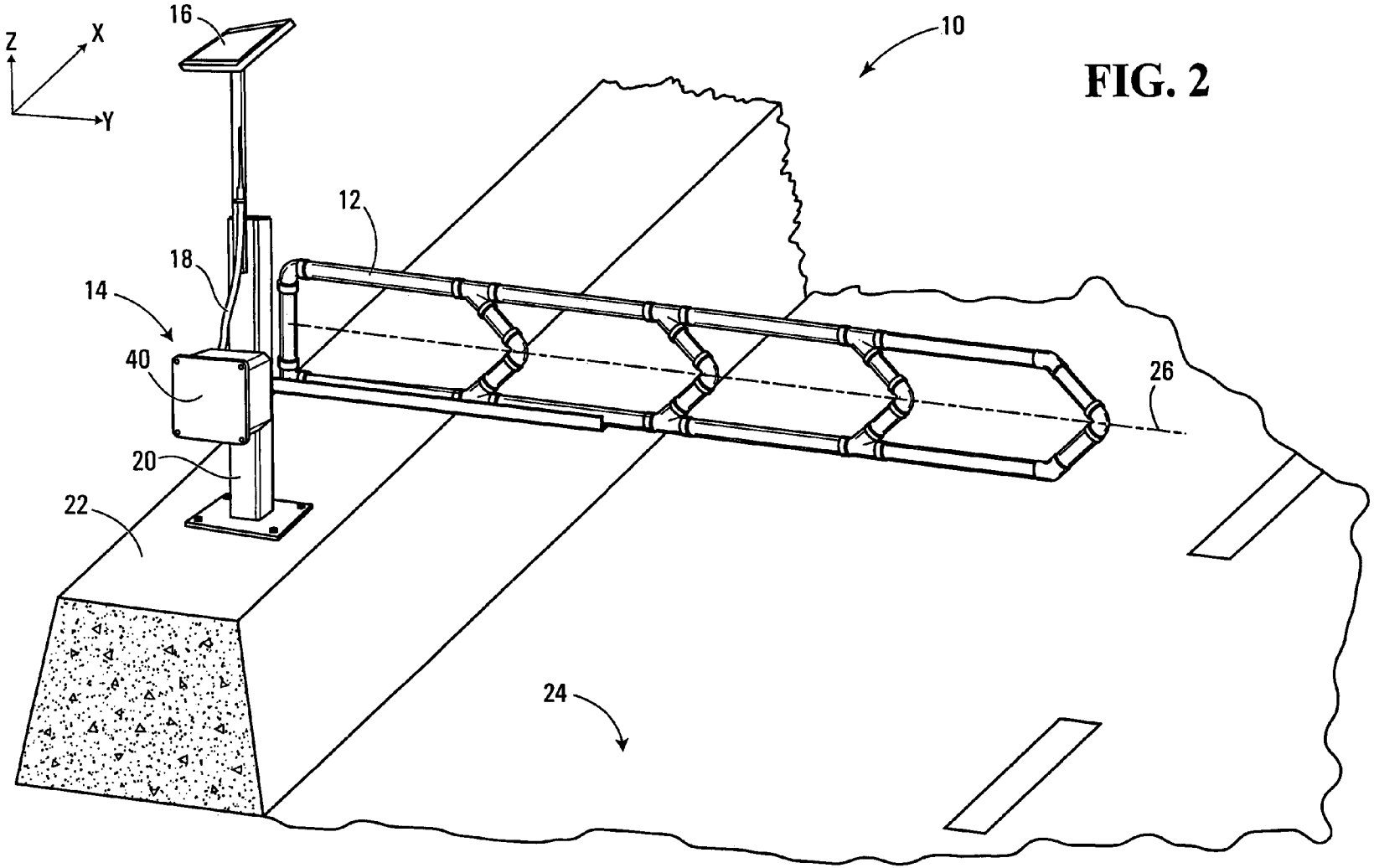
FIG. 2 shows the traffic-signalling device of FIG. 1, with the movable member in a second position.

Shown in FIGS. 1 and 2, is a traffic-signalling device 10 in accordance with a non-limiting embodiment of the present invention. As will be described in more detail further on in the specification, the traffic-signalling device 10 is operative for providing information to oncoming traffic relating to driving instructions and/or upcoming road conditions. For example, the information provided by the traffic-signalling device 10 can include driving instructions, such as stop, slow down, switch lanes or drive within a specific speed limit. Or, the information provided by the traffic-signalling device 10 can inform the oncoming traffic of upcoming road conditions, such as construction ahead, men at work, lanes merging, or the fact that a lane is closed or blocked. The traffic-signalling device 10 can convey such information to oncoming traffic via text, images, or simply via a physical barrier.

As shown in FIG. 1, the traffic-signalling device 10 includes a moveable member 12 and a solar powered drive system 14. The moveable member 12 is moveable between a first position, shown in FIG. 1, and a second position, shown in FIG. 2. When the moveable member 12 is in the second position, it is operative to provide the oncoming traffic with information.

In a first non-limiting example of implementation, the information that is provided to the oncoming traffic when the moveable member 12 is in the second position is that a barrier is physically present across the shoulder, lane or road. No sign other than the visually perceptible presence of a physical obstruction is provided. The presence of the physical obstruction conveys to oncoming traffic that the portion of the road into which it extends is closed or blocked. For example, the physical obstruction can convey to the oncoming traffic that the shoulder of the road, or an entire lane of the road, is closed.

Figure 3A:
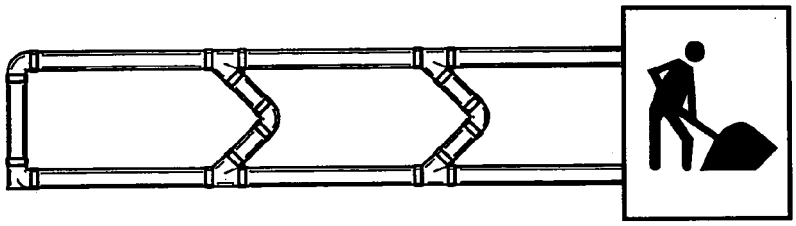
FIGS. 3A–3C show a plurality of movable members, each in accordance with a non-limiting example of implementation.
Figure 3B:
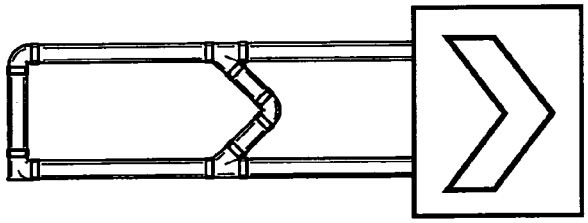
Figure 3C:
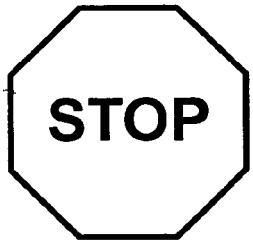
Figure 3D:
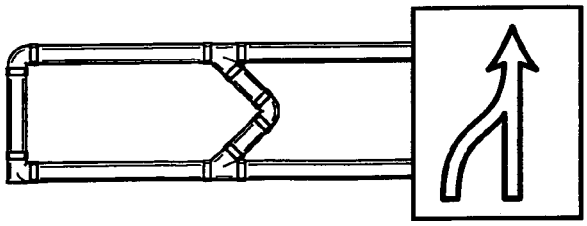

In an alternative example of implementation, additional information is provided to the oncoming traffic when the moveable member 12 is in the second position. This additional information is conveyed via text and/or an image located on the moveable member 12. Shown in FIGS. 3A through 3D are some non-limiting examples of moveable members 12 that contain text and/or images for conveying information to oncoming traffic in addition to a physical obstruction barrier. For example, FIG. 3A shows a moveable member that includes a sign containing an image that informs traffic that there is work being performed on the upcoming road. FIG. 3B shows a moveable member that includes a sign containing an image that informs traffic that they should move into a right lane. In an alternative embodiment, wherein the traffic signalling device 10 is located on the opposite side of the road, the movable member 3B can swing into the left lane, thereby informing traffic that they should move into a left lane. FIG. 3C shows a moveable member in the form of a stop sign that includes text for informing traffic that they should stop. As such, the moveable member shown in FIG. 3C is the traffic sign itself. In this embodiment, the traffic-signalling device has no physical barrier and includes only a sign that conveys information to the oncoming traffic. FIG. 3D shows a moveable member that includes a sign containing an image that informs traffic that two lanes will be merging into one lane. It should be understood that the examples shown in FIGS. 3A through 3D are simply examples, and that moveable members that include other text or images for providing information to oncoming traffic are also included within the scope of the present invention.

As mentioned above, the moveable member 12 is operative to provide information to oncoming traffic when it is in a second position. Accordingly, the moveable member 12 can be considered to be in the second position when it is positioned such that it is readily visible to the oncoming traffic. In the non-limiting example of implementation shown in FIG. 2, wherein the moveable member 12 is a barrier arm, the moveable member 12 is in the second position when its longitudinal axis 26, shown in dotted lines, is substantially perpendicular to the direction of oncoming traffic. In this manner, the moveable member is able to convey to the oncoming traffic that the lane into which the barrier arm extends is closed. It should however be understood that it is not necessary for the moveable member to extend into a lane of traffic. For example, in the case where the moveable member 12 is the stop sign, as shown in FIG. 3C, in the second position, the moveable member faces the oncoming traffic but only extends into the shoulder of the road.

When the moveable member 12 is in the first position, as shown in FIG. 1, the information that it conveys to the oncoming traffic when it is in the second position, is no longer conveyed to the oncoming traffic. In the first position, the information to be conveyed by the moveable member 12 does not face the oncoming traffic, and as such is not readily visible. In the non-limiting example shown in FIG. 1, the moveable member 12, which is in the form of a barrier arm, is in the first position when its longitudinal axis 26 is substantially parallel to the direction of oncoming traffic. In such a position, the moveable member is not readily visible to oncoming traffic, and does not block the lane of traffic, and as such, does not convey information to oncoming traffic that the road on which the oncoming traffic is travelling is blocked or closed.

In the non-limiting embodiment of a traffic-signalling device 10 shown in FIGS. 1 and 2, the moveable member 12 moves between the first position and the second position by rotating by 90 degrees about a z axis. It should be understood that other manners of moving between the first position and second position are included within the scope of the present invention. For example, the moveable member 12 could move between the first position and the second position by rotating by 90 degrees about the x axis. Alternatively, in the case where the moveable member 12 does not extend into the road, such as in the case where the moveable member 12 is a stop sign, the moveable member could move between the first position and the second position by rotating by 90 degrees about y axis, such that when in the first position, the text of the stop sign faces the sky, thereby rendering it invisible to oncoming traffic. In a further embodiment, the moveable member 12 may move along more than one axis when moving between the first position and the second position. For example, when moving from the second position to the first position, the moveable member 12 might first rotate by 90 degrees about the x-axis, and then rotate by 90 degrees about the y axis. In yet a further embodiment, the moveable member 12 could be a telescopic member that extends into traffic when in the second position, and retracts into a compartment when in the first position. As such, the information to be conveyed to the oncoming traffic would be visible to the oncoming traffic when the moveable member 12 is in the second position, and would be hidden from view when in the first position.

The moveable member 12 can be made from a variety of different materials. Some non-limiting examples of materials that can be used to form the moveable member 12 include steel, aluminium and plastic, among others. In addition, the moveable member can be of a variety of different lengths. For example, in the case where the moveable member is a barrier arm, as shown in FIGS. 1 and 2, the length of the moveable member can be quite long, such that it is able to extend into a lane of traffic. However, in the case where the moveable member is a road sign, as shown in FIG. 3C, the length of the moveable member can be quite short, such that the moveable member fits within the shoulder of the road.

Figure 9A:
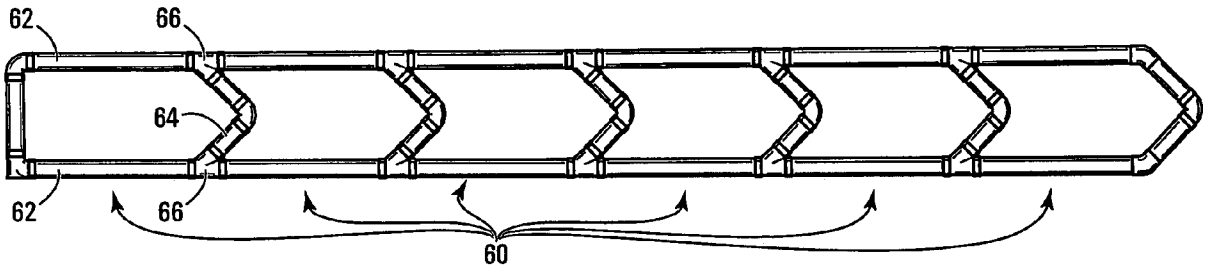
FIGS. 9A–9E show a plurality of movable members having different lengths in accordance with the present invention.
Figure 9B:
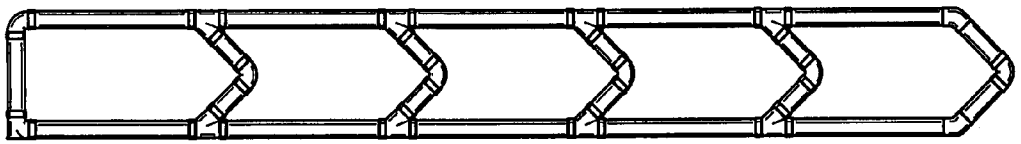
Figure 9C:
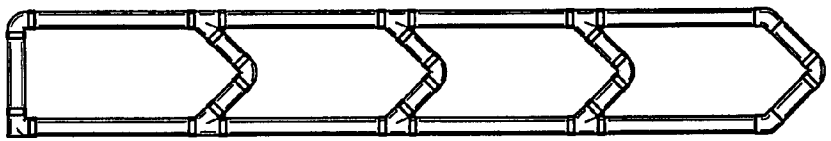
Figure 9D:
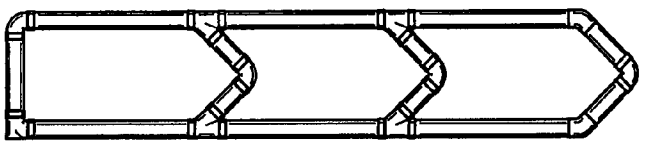
Figure 9E:
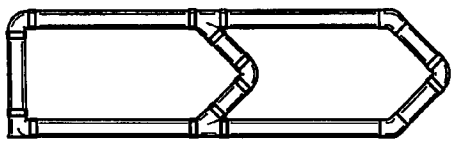

In a specific example of implementation, the moveable member 12 can be made of a modular components that are able to fit together in order to form a moveable member of a certain length. Shown in FIGS. 9A through 9D are moveable members 12 that include different numbers of modular components 60. For example, the moveable member 12 shown in FIG. 9A is formed of 6 modular components 60, and the moveable member 12 shown in FIG. 9E is formed of only 2 modular components 60. As such, the length of the moveable member 12 depends on the number of modular components 60 connected together. In the specific example of modular components 60 shown in FIGS. 9A through 9D, each modular component includes two lateral parts 62 and a cross member 64 that connects to the two lateral parts 62 at joint regions 66. In order to connect two modular components 60 together, the two lateral parts 62 are inserted into the joint regions 66.

As shown in FIGS. 1 and 2, the moveable member 12 is attached to a support 20, which in the non-limiting embodiment shown is a post that is connected to a concrete barrier 22 located by the side of a road 24. In alternative embodiments, the support 20 can be a post that is connected directly to the road 24 itself, or the support 20 can be an existing structure, such as a lamp-post, overpass, or street sign to which the moveable member 12 can be attached.

As mentioned above, the traffic-signalling device 12 includes a solar powered drive system 14. It is the solar powered drive system 14 that is operative for causing the moveable member 12 to move between the first position and the second position.

Figure 4:
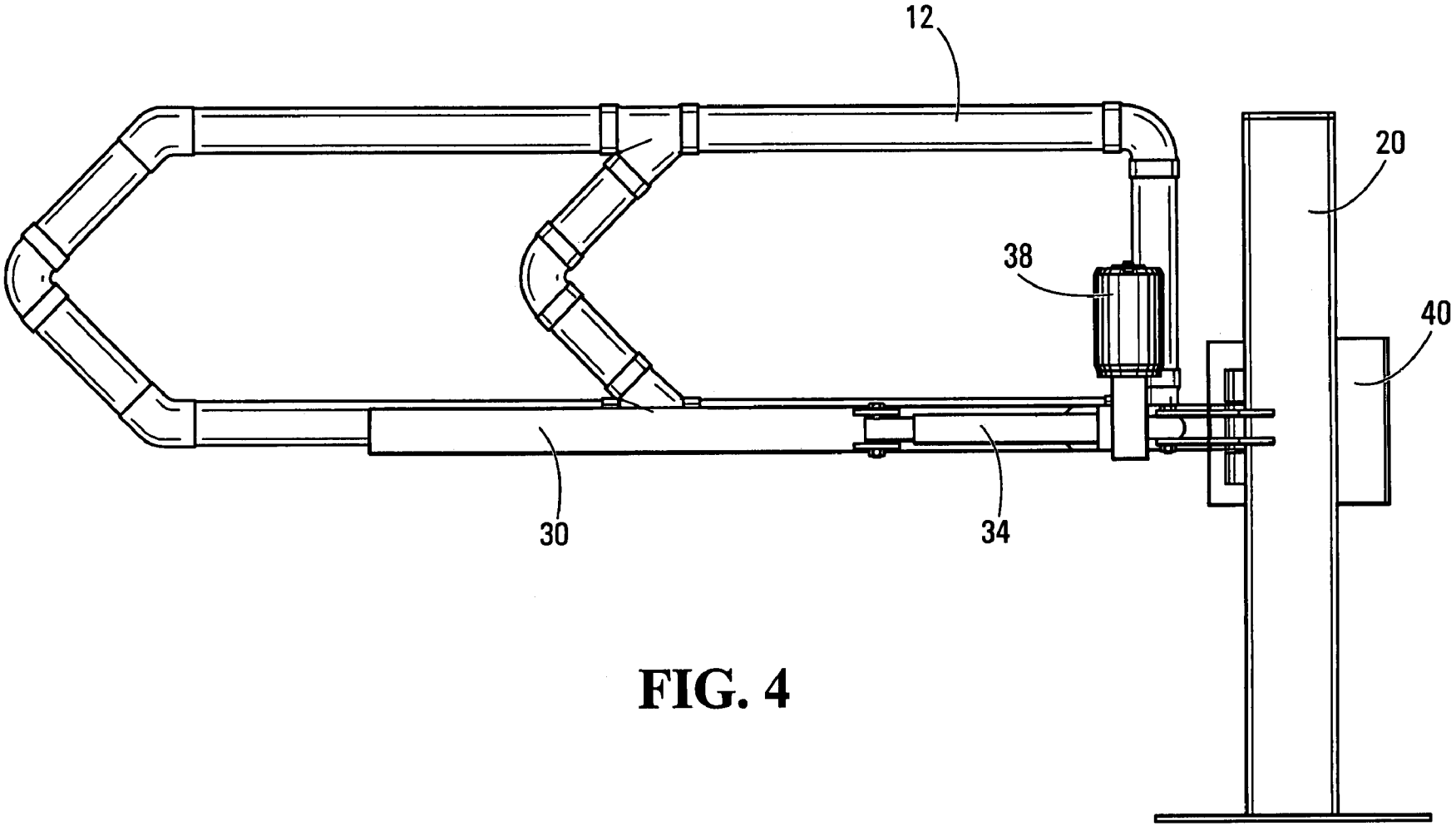
FIG. 4 shows a side elevational view of the traffic-signalling device shown in FIG. 1.
Figure 5:
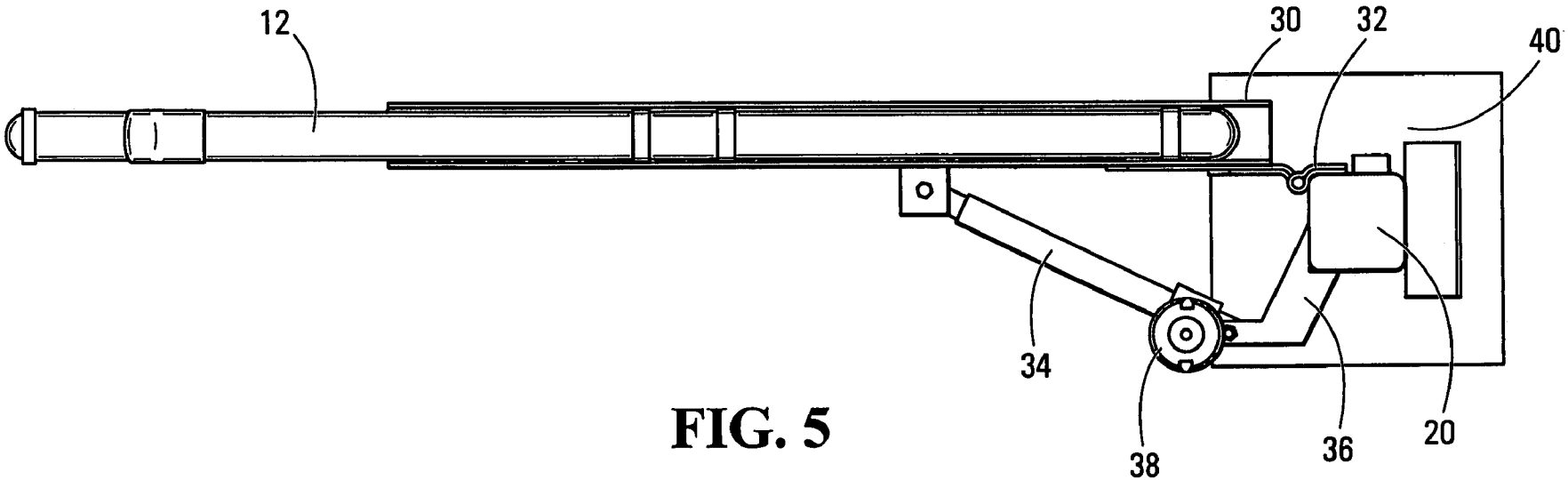
FIG. 5 shows a top plan view of the traffic-signalling device shown in FIG. 4.
Figure 6:
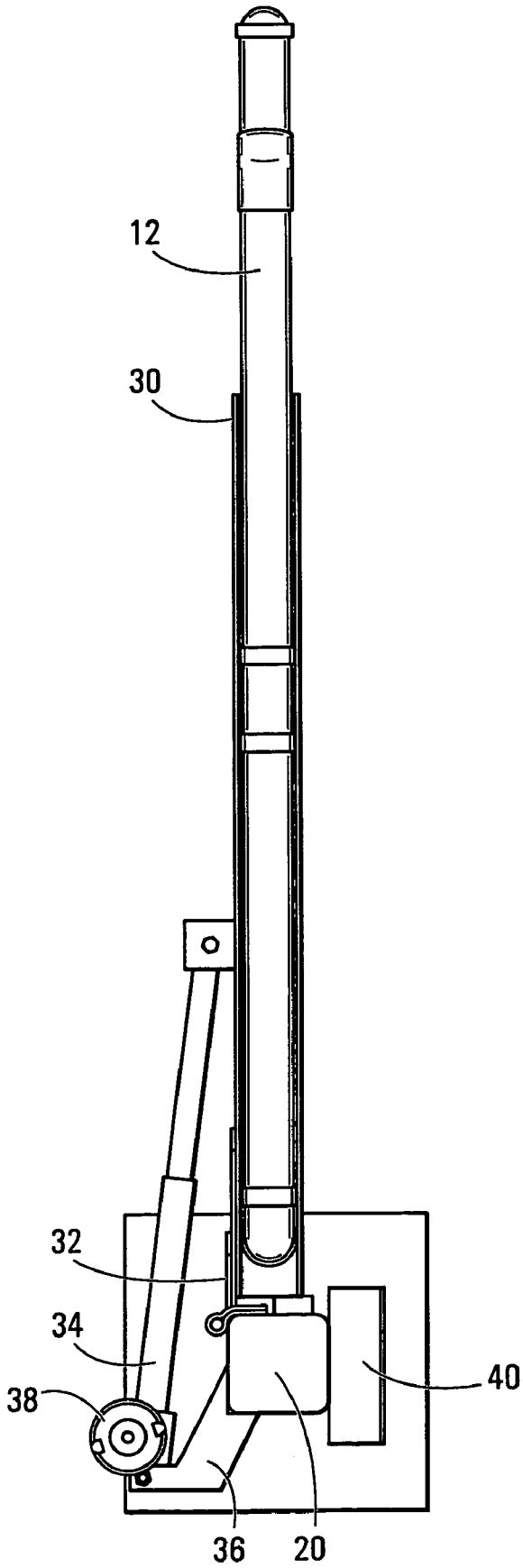
FIG. 6 shows a top plan view of the traffic-signalling device shown in FIGS. 4 and 5.

In a first example of implementation, the solar-powered drive system 14 includes an electric battery 40 and an actuator in the form of an electric motor 38, as shown in FIGS. 4, 5 and 6. It is the electric battery 40 that provides the electric motor 38 with electricity. The electric battery 40 is adapted to be connected to a solar energy collector 16 via a cable 18 for receiving electricity generated by the solar energy collector 16. In the embodiment shown in FIG. 1, the solar energy collector 16 is in the form of a plurality of solar cells. A non-limiting example of solar cells suitable for use with the traffic-signalling device described above, are Uni-Solar framed panels which can be obtained from United Solar Ovonics in Auburn Hills, Mich. It should however be understood that any other type of solar energy collector known in the art is included within the scope of the present invention.

In a possible variant, the electric battery may be omitted and replaced by another type of energy storage device that can accumulate enough energy to operate the actuator. A capacitor is an example of an alternative to the electric battery. This variant could work well with actuators other than electric motors, such as solenoids, for instance.

In another possible variant, the energy storage device can be omitted. This is suitable for applications where the solar energy collector 16 is large enough to directly power the actuator.

In the non-limiting example of implementation shown in FIGS. 4, 5 and 6, the moveable member 12 is attached to the support 20, via a hinge 32 and a support arm 30. In the specific embodiment shown, the support arm 30 is a U-shaped bar that is able to receive the moveable member 12 therein. In an alternative embodiment, the support arm 30 can be a solid bar or any other type of device that is suitable for supporting the weight of the moveable member 12. In an alternative embodiment, no support arm 30 is necessary, and the moveable member 12 can be directly connected to the hinge 32. For example, in the case where the movable member 12 is a traffic sign, as illustrated in FIG. 3C, a support arm 30 is not necessary.

In addition, a mechanical actuator 34 is attached to the support arm 30 at one end, and is attached to a piston-supporting arm 36 at the other end. The mechanical actuator 34 is connected to the electric motor 38 such that the rotary motion of the electric motor is converted into linear motion, which is able to move the movable member 12. More specifically, the motor is able to move the mechanical actuator 34 between a retracted position and an expanded position. In a non-limiting example of implementation, the mechanical actuator 34 can be a worm screw. As the electric motor 38 moves the mechanical actuator 34 between the retracted position, shown in FIG. 5, and the extended position, shown in FIG. 6, the moveable member 12 moves from the first position to the second position, as described above.

Although not shown in the Figures, the traffic-signalling device 10 further includes a control system for controlling the operation of the electric motor 38. In a non-limiting example of implementation, the control system is also solar powered.

In a non-limiting embodiment, the control system is powered directly from the solar energy collector, and in another non-limiting embodiment, the control system is powered from the energy storage device, such as the electric battery 40. The control system is designed to receive a command cause the drive system 14 to operate in order to implement the command.

In a non-limiting example, the control system receives wireless commands. The wireless commands can be transmitted from a remote control unit that is suitable to be operated by a highway employee, or from a cellular telephone, for example. For wireless operation, the control system is provided with a receiver circuit having an antenna and the associated circuitry to extract the command information contained in the wireless transmission. The command information can be extracted in any manner known in the art. If the wireless command is indicative that the movable member 12 should move from the first position to the second position, the control system operates the electric motor 38 of the drive system 14, accordingly, so as to provide the desired operational behaviour. The control system can also respond to a command to move the movable member 12 back to the first position, by operating the electric motor 38 in a reverse direction.

Embodiments using a solar powered control system, without using a solar powered drive system 14 can also be considered. For example, the movable member 12 may be operated by a spring or any other resilient device that is compressed to store enough energy to cause the movable member 12 to move from the first position to the second position. Under this embodiment, the drive system including the spring also has the necessary linkage to cause the movable member 12 to move under the influence of the spring, via a latch system that keeps the spring in a compressed condition. The solar powered control system controls this latch. As such, when a command is received by the control system for moving the movable member 12 to the second position, the control system releases the latch and the spring drives the movable member 12 to the second position. In this embodiment, the movable member 12 is then manually moved back to the first position and latched in order to re-compress the spring such that it is ready for another remotely operated deployment cycle.

Figure 7A:
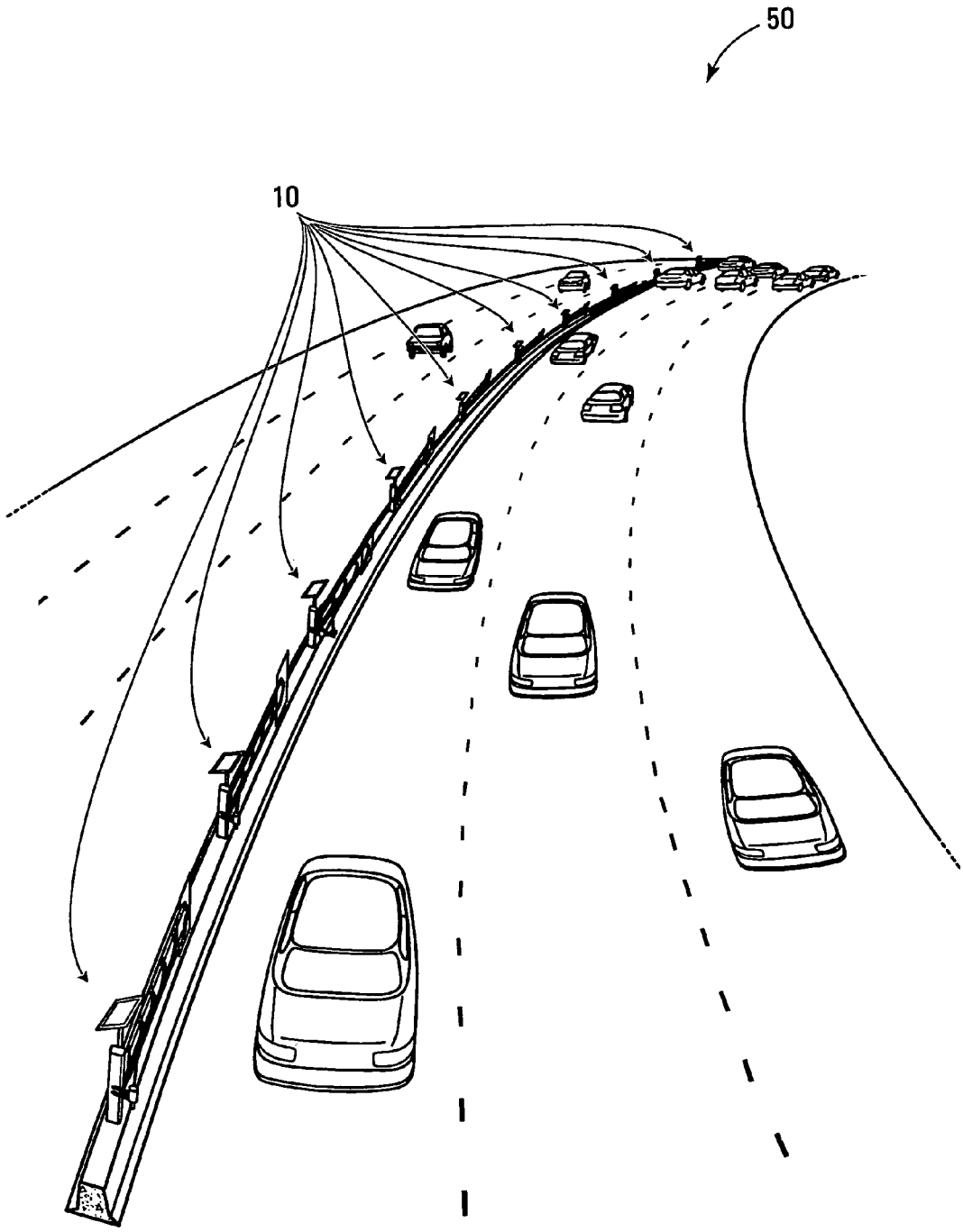
FIG. 7A shows a representation of a traffic-signalling system in accordance with a first non-limiting example of implementation of the present invention.
Figure 7B:
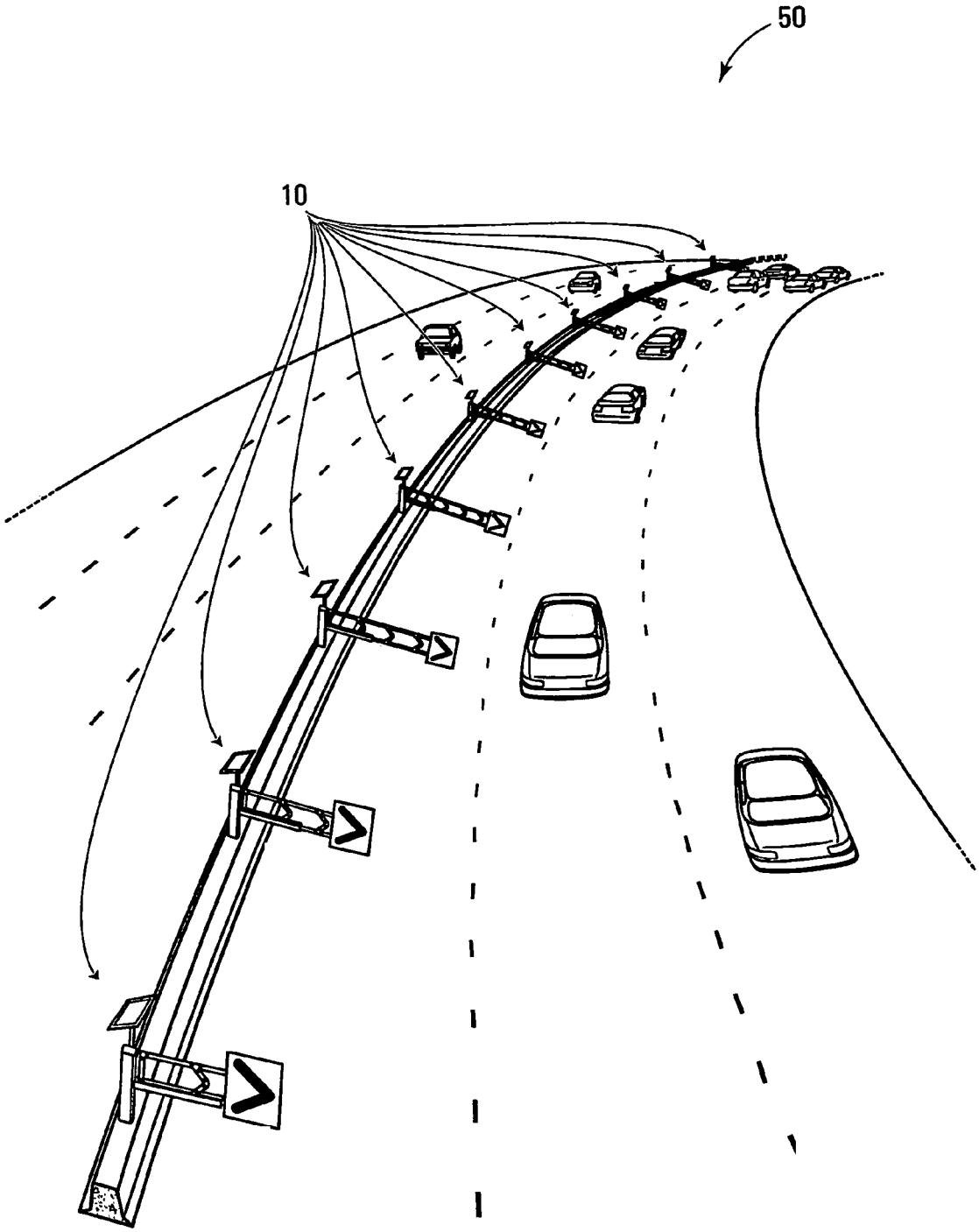
FIG. 7B shows a representation of the traffic-signalling system of FIG. 7A blocking a lane of traffic.

In another non-limiting example of implementation, a plurality of traffic-signalling devices 10 can be used in combination in order to form a traffic-signalling system 50, as shown in FIGS. 7A and 7B. The traffic-signalling system 50 shown in FIGS. 7A and 7B is operative to block or close a lane of traffic in a multi-lane road. FIG. 7A shows the plurality of traffic-signalling devices 10 with their respective moveable members 12 positioned in the first position, wherein they are not providing any information to the oncoming traffic. FIG. 7B shows the plurality of traffic-signalling devices 10 with their respective moveable members 12 positioned in the second position wherein the moveable members provide information to the oncoming traffic. In the specific example shown in FIGS. 7A and 7B, the moveable members 12 are barrier arms that when in the second position convey to oncoming traffic that the lane into which the barrier arms extend is closed.

In the non-limiting example of implementation shown in FIGS. 7A and 7B, the length of each moveable member 12 is different, such that the length of the moveable members 12 increases in the direction of traffic. This provides oncoming traffic with the opportunity to merge into the lane to the right of the lane being closed. It should be understood that in an alternative example of implementation, the movable member is located in the right lane of traffic, thereby providing oncoming traffic with the opportunity to merge into the lane to the left of the lane being closed.

In operation, in order to close the lane of traffic using the traffic-signalling system 50 shown in FIGS. 7A and 7B, a highway worker can drive up to the first traffic-signalling device 10 located by the side of the road, and can slow down and stop, while using the vehicle's hazard lights such that the cars following behind do not accidentally drive into the highway worker's vehicle. Ideally, the highway worker would have flashing lights on the vehicle in the shape of an arrow, in order to indicate to traffic following behind that they should move into a different lane. Once the highway worker has approached the first traffic-signalling device 10, and stopped his/her vehicle, the highway worker can manually activate the electric motor, or can use a remote control unit in order to send a wireless command signal to the traffic-signalling device's control system, indicating that the moveable member 12 should move into the second position. Upon receipt of the wireless signal, the control system of the first traffic-signalling device 10 activates the electric motor 38, which receives electricity from the electric battery 40, to move the moveable member 12 into the second position.

In a non-limiting example of implementation, the traffic-signalling devices 10 in the traffic-signalling system 50 are able to communicate with one another. For example, when a first traffic-signalling device 10 receives a signal for causing its moveable member 12 to move, that first traffic-signalling device 10 is able to communicate with other traffic-signalling devices 10 for transmitting signals for causing their moveable members 12 to move.

In a first specific example of implementation, the traffic-signalling devices 10 can communicate via an electric wire that runs from the control system of one traffic-signalling device 10 to the control system of another traffic-signalling device 10. Alternatively, the traffic-signalling devices 10 can communicate via wireless signals, such as RF signals or infrared signals, that can be sent from one control system to other control systems. For example, the first control system that receives a signal for causing the movement of its moveable member 12 is then able to send a wireless signal to a plurality of other control systems for causing the movement of the other traffic-signalling devices' moveable members 12. Alternatively, a first control system that receives a signal for causing the movement of its moveable member 12 then sends a wireless signal to the control system of its adjacent traffic-signalling device 10. Then that second control system sends a wireless signal to the control system of the next adjacent traffic-signalling device 10 and so on. In such a scenario, the moveable members 12 in the traffic-signalling system 50 will open in a domino-type fashion, wherein the movement of the moveable members 12 is activated in sequence.

Figure 8:
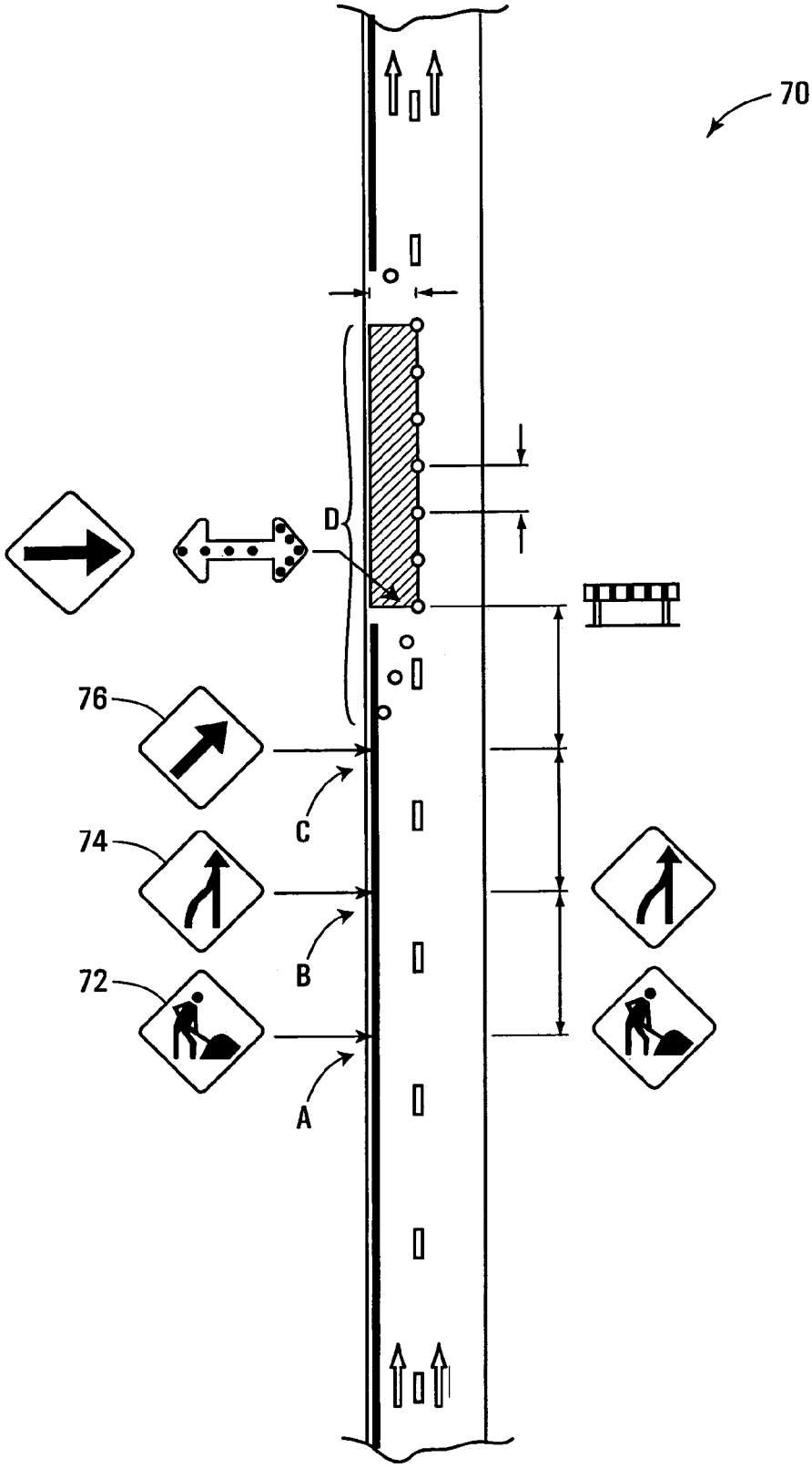
FIG. 8 shows a schematic diagram of a traffic-signalling system in accordance with a second non-limiting example of implementation of the present invention.

Shown in FIG. 8 is a schematic diagram of a traffic-signalling system 70 in accordance with a second embodiment of the present invention. Similarly to the traffic-signalling system 50 described above, traffic-signalling system 70 is also operative for closing a lane of traffic. However, in addition to having traffic-signalling devices 10 that include moveable members 12 in the form of barrier arms, traffic-signalling system 70 also includes traffic-signalling devices 10 that have moveable members 12 containing signs for informing the oncoming traffic of the upcoming closed lane.

In position A, the traffic-signalling system 70 includes a traffic-signalling device 10 that has a moveable member 12 containing traffic sign 72 for informing oncoming traffic that there will be construction ahead. Although not shown, the moveable member 12 extends into the shoulder of the road when in the second position, such that the sign 72 is visible to oncoming traffic. At position B, which is a few meters beyond position A, the traffic-signalling system 70 includes a second traffic-signalling device 10 that has a moveable member 12 containing traffic sign 74 for informing oncoming traffic that the lanes are merging. At position C on the road, which is a few meters beyond position B, the traffic-signalling system 70 includes a third traffic-signalling device 10 that has a moveable member 12 containing traffic sign 76 for informing oncoming traffic to move to the right. Then, at road section D, the traffic-signalling system 70 includes a plurality of traffic-signalling devices 10 having moveable members 12 in the form of barrier arms for informing the oncoming traffic that a portion of the road is closed. For example, the barrier arm could inform the oncoming traffic that the shoulder of the road is closed, or could inform the oncoming traffic that an entire lane of the road is closed.

The combination of traffic-signalling devices 10 having movable members containing signs, and traffic-signalling devices 10 containing movable members in the form of barrier arms, provides a safer traffic-signalling system for blocking a lane of traffic, since it provides the oncoming traffic with advanced warning of what to expect on the upcoming road.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A traffic-signalling device suitable for redirecting oncoming traffic, said traffic-signalling device comprising:

a moveable member suitable for attachment to a support, said movable member being formed of multiple modular components, wherein said multiple modular components can be assembled in any order in order to form said movable member, said moveable member being operative to move between a first position and a second position, wherein when said moveable member is in said second position said traffic-signalling device is operative to redirect oncoming traffic;

a solar-powered drive system for causing said moveable member to move between said first position and said second position.

2. A traffic-signalling device as defined in claim 1, wherein said solar-powered drive system includes an electric battery and an electric motor.

3. A traffic-signalling device as defined in claim 2, wherein said electric battery is charged by one or more solar cells.

4. A traffic-signalling device as defined in claim 1, wherein said moveable member defines a longitudinal axis, wherein when said moveable member is in said second position, said longitudinal axis is substantially perpendicular to the direction of oncoming traffic.

5. A traffic-signalling device as defined in claim 4, wherein when said moveable member is in said first position, said longitudinal axis is substantially parallel to the direction of oncoming traffic.

6. A traffic-signalling device as defined in claim 1, wherein said moveable member includes a barrier arm that when in said second position extends into a portion of a road for informing the oncoming traffic that the portion of the road into which said movable member extends, is closed.

7. A traffic-signalling device as defined in claim 3, wherein said moveable member includes a first end and a second end, said first end being attached to said support, and said second end including at least one of an image and text thereon for providing information to oncoming traffic.

8. A traffic-signalling device as defined in claim 1, wherein the activation of said solar-powered drive system is controlled remotely.

9. A traffic-signalling device as defined in claim 3, wherein said moveable member is made from at least one material selected from the list comprising steel, aluminium and plastic.

10. A traffic-signalling system suitable for providing information to oncoming traffic, said traffic-signalling system comprising:

a plurality of traffic-signalling devices, each traffic-signalling device comprising:

i) a moveable member suitable for attachment to a support, said movable member being formed of a plurality of interchangeable modular components, said moveable member being operative to move between a first position and a second position, wherein when said moveable member is in said second position said traffic-signalling device is operative to provide information to oncoming traffic;

ii) a drive system suitable for causing said moveable member to move between said first position and said second position;

iii) a solar powered control system suitable for receiving wireless signals for causing the activation of said drive system.

11. A traffic-signalling system as defined in claim 10, wherein said drive system includes an electric battery and an electric motor.

12. A traffic-signalling system as defined in claim 11, wherein said electric battery is charged by one or more solar cells.

13. A traffic-signalling system as defined in claim 10, wherein said moveable member defines a longitudinal axis, such that when said moveable member is in said second position, said longitudinal axis is substantially perpendicular to the direction of oncoming traffic.

14. A traffic-signalling system as defined in claim 13, wherein when said moveable member is in said first position, said longitudinal axis is substantially parallel to the direction of oncoming traffic.

15. A traffic-signalling system as defined in claim 10, wherein said moveable member includes a barrier arm that when in said second position extends into a lane of traffic for informing the oncoming traffic that the lane of traffic into which said movable member extends, is closed.

16. A traffic-signalling system as defined in claim 15, wherein said barrier arm is formed of one or more modular components.

17. A traffic-signalling system as defined in claim 12, wherein said moveable member includes a first end and a second end, said first end being attached to said support, and said second end including at least one of text and an image thereon for providing information to oncoming traffic.

18. A traffic-signalling system as defined in claim 12, wherein said moveable member is made from at least one material selected from the list comprising steel, aluminium and plastic.

19. A traffic-signalling system as defined in claim 10, wherein upon receipt of a wireless signal at a first control system of a first traffic-signalling device, said first control system transmits a wireless signal to a second control systems of a second traffic-signalling device.

20. A traffic-signalling system as defined in claim 10, wherein said drive system is solar powered.

21. A traffic-signalling system as defined in claim 10, wherein said solar powered control system is operative for communicating over a wireless transmission link with a solar powered control system of at least one other traffic-signalling device in said plurality of traffic signalling devices.

22. A traffic-signalling device suitable for providing information to oncoming traffic, said traffic-signalling device comprising:

a moveable member suitable for attachment to a support, said moveable member being operative to move between a first position and a second position, wherein when said moveable member is in said second position said traffic-signalling device is operative to provide information to oncoming traffic;

a drive system suitable for causing said moveable member to move between said first position and said second position a solar powered control system suitable for:

i) allowing said drive system to move said movable member between said first position and said second position, upon receipt of a remotely transmitted command signal;

ii) communicating over a wireless transmission link with a solar powered control system of at least one other traffic-signalling device.

23. A traffic-signalling system comprising:

a plurality of movable barrier arms, each barrier arm in said plurality of barrier arms being operative to move between a first position and a second position, wherein when a barrier arm is in said second position said barrier arm forms a barrier to oncoming traffic;

a plurality of solar powered drive systems, each barrier arm in said plurality of barrier arms being associated with a respective one of said plurality of solar powered drive systems, each solar powered drive system being suitable for causing a respective barrier arm to move between said first position and said second position;

a plurality of solar powered control systems, each barrier arm in said plurality of barrier arms being associated with a respective one of said plurality of solar powered control systems;

wherein at least one solar powered control system in said plurality of solar powered control systems is operative to receive over a cellular network a command signal conveying instructions to be implemented by said solar powered control system, said at least one solar powered control system being operative for conveying said command signal to other solar powered control systems in said plurality of solar powered control systems over a wireless communication link.

24. A traffic-signalling device as defined in claim 22, wherein said drive system includes an electric battery and an electric motor.

25. A traffic-signalling device as defined in claim 24, wherein said electric battery is charged by one or more solar cells.

26. A traffic-signalling device as defined in claim 22, wherein said moveable member defines a longitudinal axis, wherein when said moveable member is in said second position, said longitudinal axis is substantially perpendicular to the direction of oncoming traffic.

27. A traffic-signalling device as defined in claim 22, wherein said moveable member includes a barrier arm that when in said second position extends into a portion of a road for informing the oncoming traffic that the portion of the road into which said movable member extends, is closed.

* * * * *